US011602675B2

(12) United States Patent
Behunin

(10) Patent No.: US 11,602,675 B2
(45) Date of Patent: Mar. 14, 2023

(54) NOVELTY GOLF BALL

(71) Applicant: Nancy Behunin, Magna, UT (US)

(72) Inventor: Nancy Behunin, Magna, UT (US)

( * ) Notice: Subject to any disclaimer, the term of this patent is extended or adjusted under 35 U.S.C. 154(b) by 0 days.

(21) Appl. No.: 17/208,415

(22) Filed: Mar. 22, 2021

(65) Prior Publication Data

US 2022/0176206 A1 Jun. 9, 2022

Related U.S. Application Data

(60) Provisional application No. 63/122,627, filed on Dec. 8, 2020.

(51) Int. Cl.

| | |
|---|---|
| ***A63H 5/00*** | (2006.01) |
| ***A63B 37/00*** | (2006.01) |
| *A63B 43/00* | (2006.01) |
| *A63B 39/00* | (2006.01) |

(52) U.S. Cl.

CPC ..... *A63B 37/0055* (2013.01); *A63B 37/0012* (2013.01); *A63H 5/00* (2013.01); *A63B 37/0023* (2013.01); *A63B 43/004* (2013.01); *A63B 2039/003* (2013.01)

(58) Field of Classification Search

CPC ..... A63B 37/0055

See application file for complete search history.

(56) References Cited

U.S. PATENT DOCUMENTS

| | | | | | |
|---|---|---|---|---|---|
| 4,872,854 | A * | 10/1989 | Hesu | G04G 17/08 | D14/176 |
| 5,316,293 | A * | 5/1994 | Hamilton | A63B 43/06 | 446/485 |
| 5,447,314 | A * | 9/1995 | Yamazaki | A63B 43/00 | 473/353 |
| 5,810,685 | A * | 9/1998 | Willner | A63B 43/00 | 473/576 |
| 5,820,484 | A * | 10/1998 | Terry | A63B 37/0003 | 473/356 |
| 6,011,466 | A * | 1/2000 | Goldman | A63B 43/00 | 340/8.1 |
| 6,113,504 | A * | 9/2000 | Kuesters | G01S 5/0081 | 473/200 |
| 6,142,894 | A * | 11/2000 | Lee | A63B 43/06 | 473/570 |
| 6,884,180 | B2 * | 4/2005 | Corzilius | A63B 37/0003 | 473/192 |
| 6,935,965 | B1 * | 8/2005 | DeVarney | A63B 69/3635 | 473/224 |
| 7,095,312 | B2 * | 8/2006 | Erario | A63B 71/06 | 342/357.57 |
| 7,207,902 | B1 * | 4/2007 | Hamlin | A63B 24/0021 | 473/353 |

(Continued)

*Primary Examiner* — Eugene L Kim
*Assistant Examiner* — Matthew B Stanczak
(74) *Attorney, Agent, or Firm* — Brennan, Manna & Diamond, LLC

(57) ABSTRACT

The present invention relates generally to a novelty golf ball that has a plurality of internal electrical components capable of storing and playing a sound recording when motion of the novelty golf ball is detected. The body of the novelty golf ball may be of unitary construction or comprised of two separate halves that may be removably attached to one another to allow a user to access the electrical components stored on the interior of the novelty golf ball.

13 Claims, 5 Drawing Sheets

(56) References Cited

U.S. PATENT DOCUMENTS 8,730,037 B2 * 5/2014 Houvener ..... G01S 19/19 340/517
9,662,556 B2 * 5/2017 San Juan ..... A63B 69/002
9,861,854 B2 * 1/2018 Kuiper ..... A63F 13/573
9,927,525 B2 * 3/2018 Zimmerman ..... G01S 19/19
10,232,225 B1 * 3/2019 Oberc ..... A63B 69/3655
10,315,077 B2 * 6/2019 Komatsu ..... A63B 43/004
10,350,461 B2 * 7/2019 Savelli ..... H01L 41/1138
10,434,375 B1 * 10/2019 Simonds ..... A63B 37/0019
10,688,366 B1 * 6/2020 Petrich ..... A63B 37/006
10,770,046 B2 * 9/2020 Totaro ..... G10H 1/32
10,864,454 B1 * 12/2020 Davis ..... G06F 3/02
10,918,929 B1 * 2/2021 Raposo ..... A63B 37/0033
11,117,024 B2 * 9/2021 Behera ..... A63B 37/12
11,344,784 B1 * 5/2022 Dykhuis ..... A63B 37/0076
2002/0091017 A1 * 7/2002 Kuesters ..... A63B 71/06 473/407
2002/0173378 A1 * 11/2002 Tinsman ..... A63B 43/00 473/351
2003/0224872 A1 * 12/2003 Boundy ..... A63B 43/00 473/351
2005/0043125 A1 * 2/2005 Nakano ..... A63B 43/00 473/571
2005/0085316 A1 * 4/2005 Barr ..... A63B 43/00 473/353
2006/0197658 A1 * 9/2006 Light ..... G08B 13/2417 340/572.1
2007/0173349 A1 * 7/2007 Eng ..... A63B 37/0003 473/570
2007/0281803 A1 * 12/2007 Jeong ..... A63B 37/02 473/371
2008/0015064 A1 * 1/2008 Nelson ..... A63H 5/00 473/571
2008/0234077 A1 * 9/2008 Glowinski ..... A63B 43/00 473/569
2009/0040761 A1 * 2/2009 Huang ..... A63B 43/06 362/253
2010/0144455 A1 * 6/2010 Ahern ..... A63B 69/3623 700/92
2010/0227705 A1 * 9/2010 Huang ..... A63B 43/00 473/570
2012/0142443 A1 * 6/2012 Savarese ..... G08B 21/0266 342/357.57
2012/0244969 A1 * 9/2012 Binder ..... A63H 29/22 473/570
2012/0255999 A1 * 10/2012 Luciano, Jr. ..... A63B 37/0003 235/492
2013/0196792 A1 * 8/2013 Shimizu ..... A63B 69/3605 473/407
2013/0225338 A1 * 8/2013 Lehmann ..... A63B 65/10 473/570
2013/0274040 A1 * 10/2013 Coza ..... A63B 43/004 473/570
2014/0256214 A1 * 9/2014 Ramamoorthy ..... A63H 3/003 446/297
2014/0309063 A1 * 10/2014 Molina ..... G10H 1/26 473/570
2015/0038274 A1 * 2/2015 Kelly ..... A63B 43/06 473/570
2015/0080142 A1 * 3/2015 Kline ..... A63B 37/0075 473/221
2015/0094168 A1 * 4/2015 Unger, Sr. ..... A63B 57/357 473/353
2015/0105172 A1 * 4/2015 Thurman ..... A63B 71/0669 473/199
2015/0105173 A1 * 4/2015 Thurman ..... A63B 71/06 473/199
2015/0290548 A1 * 10/2015 Meyers ..... A63H 3/28 446/397
2016/0059142 A1 * 3/2016 Krolewski ..... A63H 30/04 446/298
2016/0114221 A1 * 4/2016 Binder ..... G08B 21/182 473/570
2016/0114257 A1 * 4/2016 Binder ..... A63H 29/24 446/175
2019/0036360 A1 * 1/2019 Zilles ..... A63B 24/0021
2019/0158943 A1 * 5/2019 Nied ..... H04R 1/025
2020/0389715 A1 * 12/2020 Spiridigliozzi ..... H04R 1/028
2021/0275937 A1 * 9/2021 Phipps ..... A63H 5/00
2022/0008836 A1 * 1/2022 Newton ..... A63H 5/00
2022/0176206 A1 * 6/2022 Behunin ..... A63B 37/0003

* cited by examiner

NOVELTY GOLF BALL

CROSS-REFERENCE TO RELATED APPLICATION

The present application claims priority to and the benefit of U.S. Provisional Application No. 63/122,627 filed on Dec. 8, 2020, which is incorporated herein by reference in its entirety.

FIELD OF THE INVENTION

The present invention relates generally to a golfing accessory to make the sport more enjoyable. More specifically, the present invention relates to a new novelty golf ball for providing entertainment, amusement and/or humor during a round of golf or any other setting where golf balls might be used, such as a practice green, driving range, golf simulation center and the like. Accordingly, the present specification makes specific reference thereto. However, it is to be appreciated that aspects of the present invention are also equally amenable to other like applications, devices and methods of manufacture.

BACKGROUND OF THE INVENTION

Approximately eight percent of the United States population, or around twenty-five million people, participate in the sport of golf each year, and it is estimated that there are almost a half a billion golfers worldwide. Still other folks are golf enthusiasts or spectators, but may not actively partake in the game itself. In either event, there are a substantial number of individuals in the United States and around the world that are interested in the sport of golf.

As such, many golfers and golf enthusiasts desire to purchase or receive golfing-related items as gifts (e.g., for birthdays, holidays or other special occasions), and many friends and family members of golfers desire to give golf-themed gifts to their golfer. Accordingly, many individuals simply give golf balls as gifts for a golfer. However, such golf balls are typically for playing purposes only, and offer no real practical, humorous or playful element outside of creative images/text that may adorn the outer surface of the golf ball. As such, many individuals may desire to gift or receive a novelty golf ball that has a humorous or playful element that is not limited to simply funny imagery, text, or graphics printed on the outer surface of the golf ball, and that is still capable of being used as a traditional golf ball.

Therefore, there exists a long felt need in the art for an improved novelty golf ball. More specifically, there is also a long felt need in the art for a novelty golf ball that provides amusement, humor and/or entertainment to the otherwise sometimes stressful game of golf, and that can still be used as a traditional golf ball. Moreover there is a long felt need in the art for a novelty golf ball that can play a user-selectable pre-recorded message when touched or repositioned for the amusement of the golfer and those in close proximity to the golfer. There is also long felt need in the art for a novelty golf ball that can be in wireless communication with a mobile application on an electronic device, such as a smartphone, smart watch, tablet, computer or the like. Finally, there exists in the art a long felt need for a novelty golf ball that is relatively inexpensive to manufacture, and that is both safe and easy to use.

The present invention is comprised of a generally spherical and dimpled golf ball body. In the preferred embodiment, the body has an inseparable molded body. However, in alternative embodiments, the body may have two separable halves that may engage and be removably secured to one another via, for example and not limitation, a plurality of cooperating threads such that one half has a male thread and the second half has a corresponding female thread. In either event, the body further comprises an internal cavity that houses a battery, sensor, speaker, memory, wireless communication module and circuit-board assembly that are each enclosed in a singular or separate rubber core(s) to protect the same from damage. The memory further comprises a plurality of pre-recorded or live-recorded humorous phrases, songs, tones, messages, etc. that can be played through the speaker and exit out of a plurality of speaker holes that are disposed along the outside surface of the golf ball body. More specifically, the recordings are played when the sensor or circuit board detects motion or touching of the golf ball is detected by the circuit board. Additionally, the wireless communication module is capable of being paired with a mobile application on a remote electronic device to allow a user to, for example, obtain information about the location of the golf ball, upload their own custom recorded songs, messages, tones, sounds, phrases, etc. to the golf ball, communicate with another individual via the microphone and smartphone application, etc.

In this manner, the improved novelty golf ball of the present invention accomplishes all of the forgoing objectives, thereby providing a user with a novel, humorous, golf-themed gift that allows a user to create unique phrases that are audibly broadcast and are not simply written on the surface of the ball. Further, the novelty golf ball can also be used for a plurality of additional purposes as described above, and is also capable of functioning as a normal golf ball.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, includes a novelty golf ball. In the preferred embodiment, the novelty golf ball has a generally spherical and dimpled exterior comprised of a urethane, plastic or thermoplastic resin, such as Surlyn®, rubber or combinations thereof. The exterior of the body also has a plurality of continuous openings in the form of speaker holes that allow sound from the interior core of the ball to exit the device body. The body may be comprised of a one-piece molded construction, like that of a traditional golf ball. However, in an alternative embodiment, the body may include two separable halves, wherein the first half has a first or male thread and the second half has a corresponding second or female thread that is removably attachable to the first half to form a singular, continuous body. Alternatively, the two halves may also snap fit together through a series of interlocking teeth or ribs.

The body further comprises a cavity or interior that preferably houses a circuit board, speaker, battery, sensor, memory, wireless communication module and a microphone, all in electrical communication. The electrical communication can be via hard wiring or wirelessly, through a capacitive, conductive, or magnetic coupling. The circuit board has a plurality of processors that along with the memory can store pre-recorded audio, but may also record new live-audio via the microphone, which may also serve as the speaker or be a standalone device. The processor is connected to the memory module, and is used to process signals and instructions such as playback of the messages, order of the playback, etc. The messages or recordings may be set to be played in a particular order or may be played in a random order. Alternatively, the memory may also play the recording by type, such as only phrases, songs, tones, etc. The microphone may also enable two-way communication if provided with a transmitter and receiver so that someone that is connected to the golf ball on a smart device may interact with the golfer. Alternatively, the wireless communication module may be used for the same purpose. The sensor is preferably a motion sensor that is connected to the processor to commence the playing of messages upon activation (i.e., the detection of motion).

In differing embodiments, the pre-recorded phrases may include such humorous phrases as "Was that your practice shot?", "Have you considered bowling?", "Come on! Hit the ball!", etc., in addition to allowing a user to record a plurality of their own phrases and sounds into the device via the microphone and store the same in memory. Further, the wireless communication module allows the novelty golf ball to connect to a mobile application on a smart device, which allows a user to upload and record a plurality of phrases, songs, sounds, messages, tones, and combinations thereof from their smart device to the novelty golf ball. In alternative embodiments of the novelty golf ball, the playing of the phrase(s) and or sounds(s) may be triggered by the motion sensor or via a touch sensor that may also be on or near the circuit board which detects when the golf ball is hit, touched or moved.

In a further embodiment of the present invention, a method of using the novelty golf ball is disclosed. The method comprises the initial step of obtaining a golf ball that has a memory contained therein to receive recordings, sounds, messages and the like. Next, a mobile application is downloaded to an electronic device (e.g., a smart phone), and the electronic device is wirelessly paired to the novelty golf ball via a wireless communication module housed within the novelty golf ball. Next, the user can upload any of a plurality of different songs, phrases, words, messages, etc. to the memory of the novelty golf ball from the electronic device, or retrieve information from the golf ball such as its location, a recorded message stored therein, etc. After the message has been recorded or uploaded and the sensor in the golf ball senses movement, the message is played through the speaker contained therein and the sound emanates out of the speaker holes in the exterior surface of the golf ball.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION OF THE INVENTION

Figure 1A:
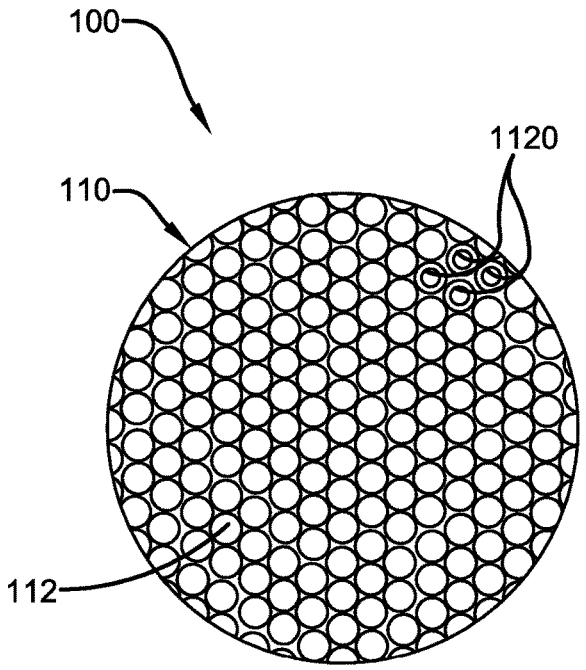
FIG. 1A illustrates a perspective view of one potential embodiment of the novelty golf ball of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

As stated above, there is a long felt need in the art for an improved novelty golf ball that provides amusement, humor and/or entertainment to the otherwise sometimes stressful game of golf, and that can still be used as a traditional golf ball. Moreover, there is a long felt need in the art for a novelty golf ball that can record, store and play pre-recorded or live messages and sounds when touched or repositioned for the amusement of the golfer and those in close proximity to the golfer. There is also long felt need in the art for a novelty golf ball that can be in wireless communication with a mobile application on an electronic device, such as a smartphone, smart watch, tablet, computer or the like. Finally, there exists in the art a long felt need for a novelty golf ball that is relatively inexpensive to manufacture, and that is both safe and easy to use.

Referring initially to the drawings, FIG. 1A illustrates a perspective view of one potential embodiment of the novelty golf ball 100 of the present invention in accordance with the disclosed architecture. The novelty golf ball 100 is preferably comprised of a generally spherical body 110 that has a plurality of dimples that are distributed evenly along the outer or exterior surface 112 the body 110 of the novelty golf ball 100. The outer surface 112 of the body 110 is preferably manufactured from a urethane or plastic resin, such as Surlyn®, rubber, composites or other thermoplastic materials or combinations thereof. The novelty golf ball 100 may be white or any other color, and the outer surface 112 may also have indicia, images, logos, patterns, phrases or combinations thereof.

Figure 1B:
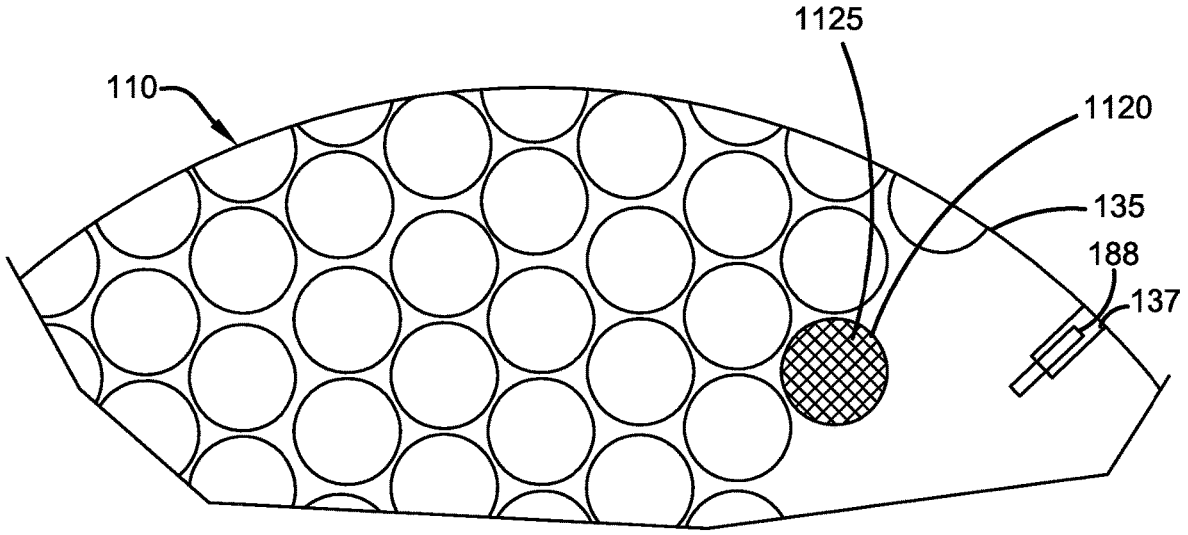
FIG. 1B illustrates a partial perspective view of one potential embodiment of the speaker openings in the exterior of the novelty golf ball in accordance with the disclosed architecture, wherein the openings are partially covered with a grill.

In the preferred embodiment of the novelty golf ball 100, the body 110 has one inseparable piece of urethane, Surlyn®, or thermoplastic material that further includes an inner solid rubber core that is also preferably spherical in shape. Any portion of the body 110 may further have a plurality of continuous openings 1120 that serve as speaker holes to allow sound generated by the speaker 170 to exit the golf ball body 110, as explained more fully below. In differing embodiments of the novelty golf ball 100, the openings 1120 may be evenly or randomly spaced apart in any position along the outer surface 112, whether individually or in a group arrangement. As best shown in FIG. 1B, the openings 1120 may further comprise a grill or other partial covering 1125, which allows sound to exit the novelty golf ball 100 but also prevents dirt and/other debris from entering the interior of the novelty golf ball 100 and damaging the internal components thereof.

Figure 2:
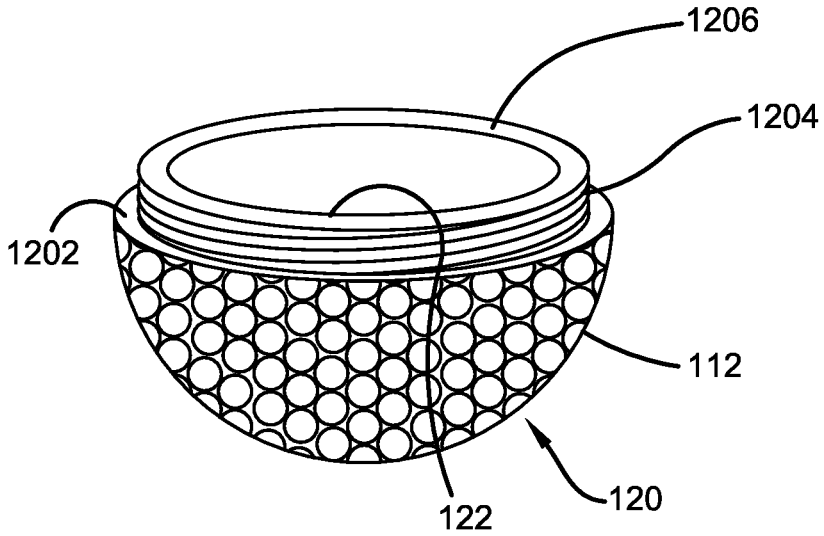
FIG. 2 illustrates a perspective view of one potential embodiment of a first half of the novelty golf ball of the present invention in accordance with the disclosed architecture.
Figure 3:
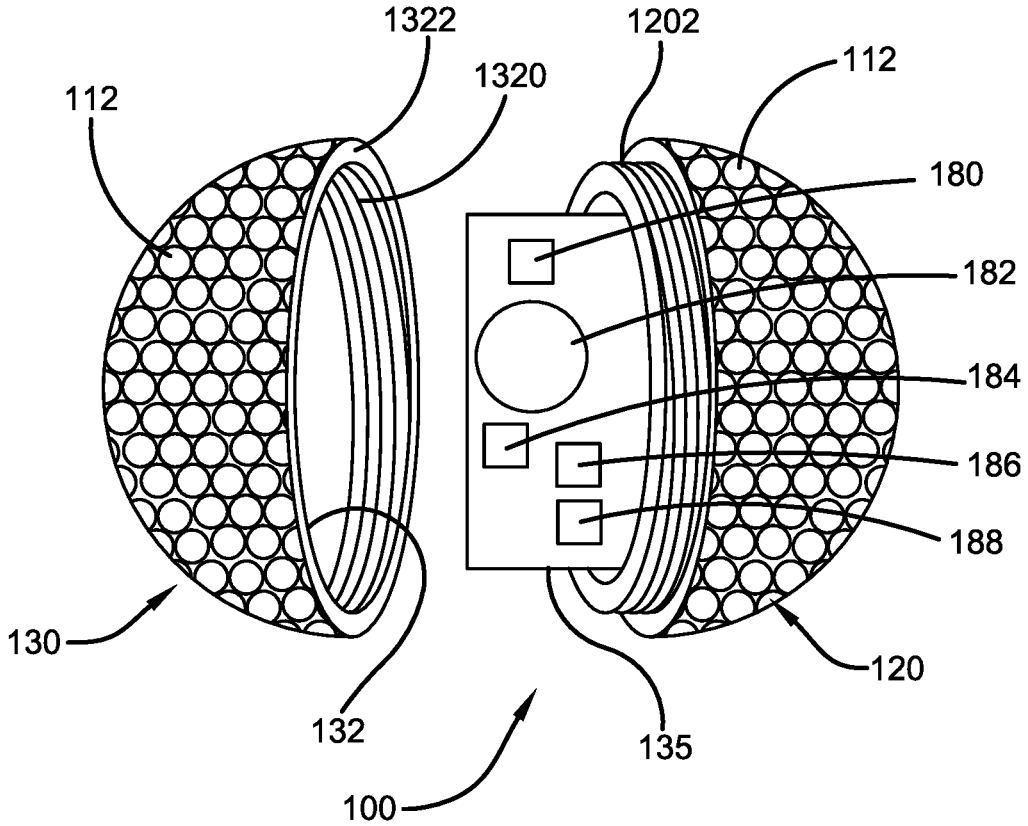
FIG. 3 illustrates a perspective and partially exploded view of one potential embodiment of the novelty golf ball of the present invention in accordance with the disclosed architecture, wherein the two halves are about to be joined together.

FIG. 2 illustrates a perspective view of one potential embodiment of a first half 120 of the novelty golf ball 100 of the present invention in accordance with the disclosed architecture, and FIG. 3 illustrates a perspective and partially exploded view of the novelty golf ball 100 of the present invention in accordance with the disclosed architecture, wherein the first and second halves 120, 130 are about to be joined together. More specifically, in one embodiment, the novelty golf ball may be comprised of a first half 120 and a second half 130. Each of the first and second halves 120, 130 is generally semi-spherical in shape, and has an internal cavity 122 that houses one or more of a circuit board 150, wiring 160, a speaker 170, a sensor 180, a memory 184, a wireless communication module 186 and a microphone 188 within the rubber core.

The rubber core may be molded around the circuit board 150 and other components, other than the speaker 170 and/or microphone 188 to provide protection to the same. The first half 120 preferably has a male threaded member 1204 that is generally circular in shape and that rests upon a lip 1202 of the first half 120, such that the diameter of the threads 1204 is smaller than the diameter of the first half 120. The threads 1204 further comprise a relatively flat top surface 1206.

The second half 130 of the body 110 can be best observed in FIG. 3, wherein the relationship between the first half 120 and the second half 130 becomes fully apparent. Similar to the first half 120, the second half 130 also has an internal cavity 132 that houses the rubber core and one or more of the various components listed above. Further, the second half 130 comprises a plurality of female threads 1320 that are recessed into the surface of the cavity 132 such that the male threads 1204 of the first half 120 can be inserted into the second half 130 and twisted to lock both halves 120, 130 together to form one continuous body 110 of the novelty golf ball 100. The second half 130 also has a relatively flat top surface 1322 that rests against the lip 1202 of the first half 120 in order to ensure that both halves 120, 130 remain together and in a level fashion.

As stated above and best shown in FIG. 3, the body 110 of the novelty golf ball 100 houses a circuit board assembly 150 and a speaker 170 within the internal cavities of 122, 132 of the first and second halves 120, 130, respectively. More specifically, the circuit board 150 and speaker 170 may be encased in a half-spherical (bisected horizontally) rubber core 135 (see FIG. 3), or provided on the outside of the core 135 that is manufactured from a polybutadiene or other synthetic rubber core. In addition to retaining the performance benefits of a traditional golf ball, the rubber core 135 ensures that the circuit board 150, speaker 170 and other internal components do not move or rattle when the novelty golf ball 100 is in motion. Nonetheless, as explained above, it is also contemplated that in the singular inseparable body 110 embodiment of the gold ball 100, the rubber core encloses each of the circuit board 150, wiring 160, speaker 170, sensor 180, memory 184, wireless communication module 186 and microphone 188 within itself.

Figure 4:
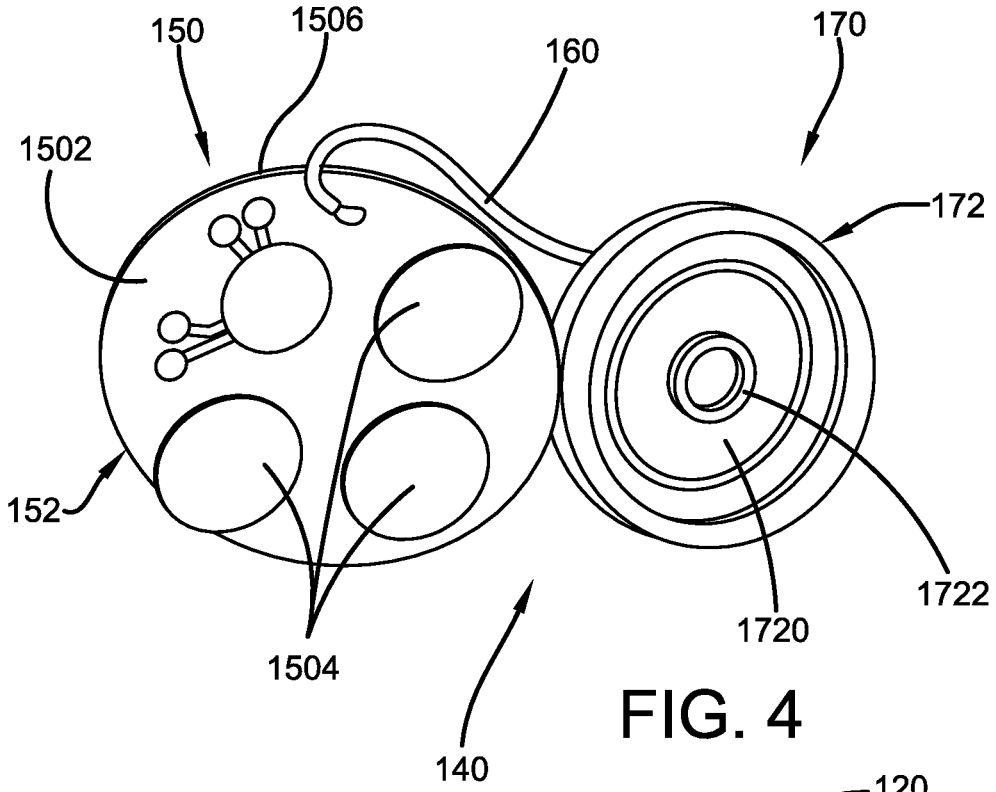
FIG. 4 illustrates a perspective view of one potential embodiment of the two interior halves of the novelty golf ball of the present invention in accordance with the disclosed architecture.
Figure 5:
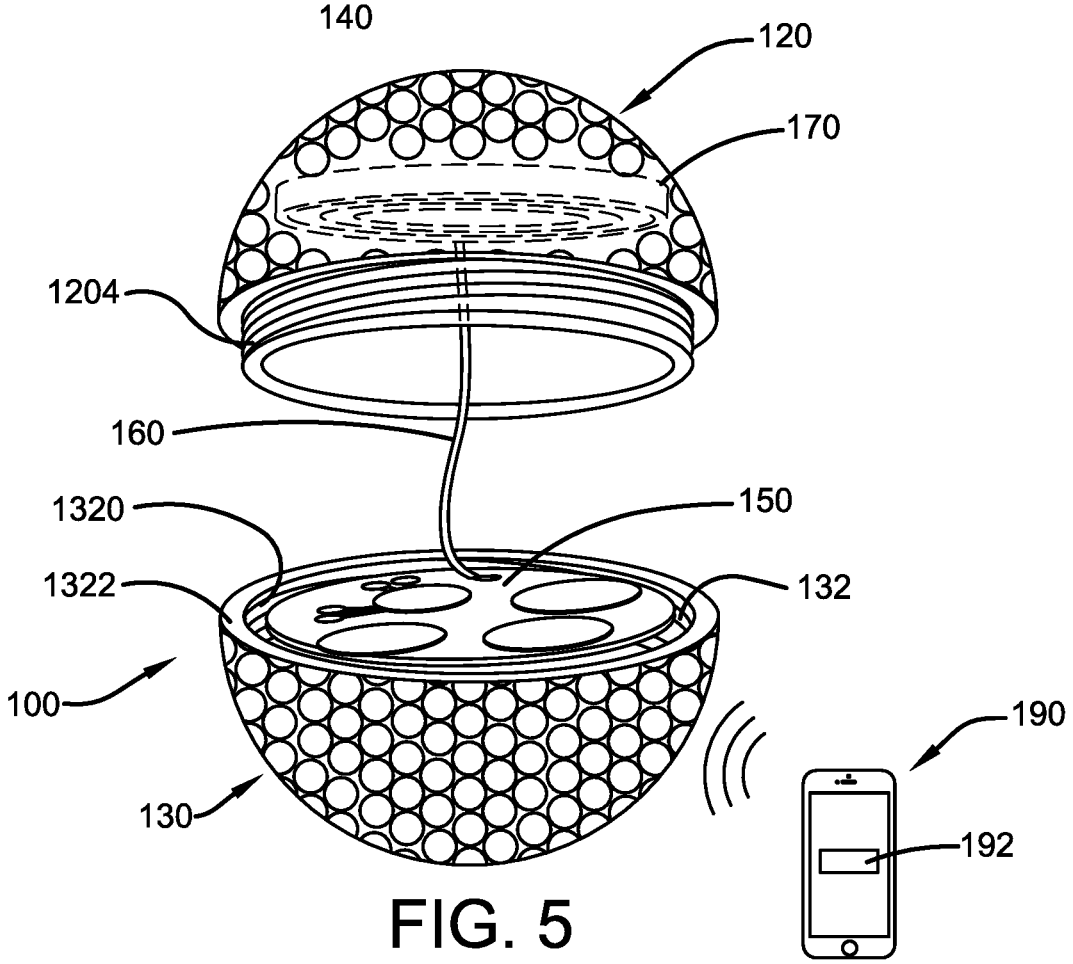
FIG. 5 illustrates a perspective and partially exploded view of one potential embodiment of the novelty golf ball of the present invention in accordance with the disclosed architecture, wherein the two halves are separated to expose the interior components.

FIG. 4 illustrates a perspective view of one potential embodiment of the two interior halves 120, 130 of the novelty golf ball 100 of the present invention in accordance with the disclosed architecture. More specifically, one or more of the circuit board 150, wiring 160, speaker 170, sensor 180, memory 184, wireless communication module 186 and microphone 188 may be stored within either cavity 122, 132 of either half 120, 130 of the body 110 and within their own half-spherical rubber core 135, or one continuous rubber core. The circuit board 150 is desirably a generally circular body 152 that has a top surface 1502 that includes a plurality of circuits. The circuit board 150 may also have one or more processors 1504 and memory 184 that store the pre-recorded or live messages, phrases, sounds, songs, tones or combinations thereof that may be emitted from the golf ball 100 via the speaker 170. Such pre-recorded phrases could include humorous phrases such as, but not limited to, "Was that your practice shot?", "Have you considered bowling?", "Come on! Hit the ball!", etc. Differing embodiments of the novelty golf ball 100 may also include a plurality of sound effects such as, but not limited to, the sound of an explosion, gunshot, pop, bang, whoopie cushion noise, etc., and may also have musical songs, tones, sounds, notes or combinations thereof.

As stated above, the novelty golf ball 100 may further comprise a wireless communication module 186, such as a Bluetooth, RFID, NFC transmitter or the like that allows an individual to wirelessly communicate between the novelty golf ball 100 and a mobile application 190 on an electronic device 192. The user can then use the mobile application 190 on the electronic device 192, such as, but not limited to, a smartphone, smart watch, tablet, computer, etc., to upload, record, select and edit a plurality of custom sounds, songs, messages, tones, phrases, explosions, gunshots, pops, bangs, whoopie cushion noises or combinations thereof that may be emitted by the speaker 170. The speaker 170 remains in electrical communication with the circuit board 150 via wiring 160 that extends between the top surface 1502 of the circuit board 150 and the speaker body 172. Alternatively, the circuit board 150 and the speaker 170 (or any of the other components) could be capacitively, conductively or magnetically coupled to one another to avoid the additional wiring.

It is further contemplated that in any embodiment of the novelty golf ball 100, the playing of the messages, song, sound, tone, phrase, etc. is triggered by a motion sensor 182 or touch detector that may be positioned on, or in electronic communication with, the circuit board 150 of the novelty golf ball 100. The sensor 182 may further detect when the outer surface 112 of the golf ball 100 is struck by a golf club, when the golf ball 100 begins to roll/move through the air or along the ground, and its location (e.g., after having been struck a long distance). The novelty golf ball 100 may also have a means within the mobile application 190 to allow a user to enable or disable one or more of the motion sensor 182 and the other components so as to not interrupt round of golf, or in a setting when such noises would not be appropriate.

The speaker 170 is preferably comprised of a battery coil 1722 that engages a battery 180 that may be housed on the bottom surface 1506 of the circuit board 150. In differing embodiments, the golf ball 100 may be powered by a plurality of coin cell or button cell battery types such as, by way of example and not limitation, CR2032, CR2025, CR2320, etc. The battery 180 may be a disposable battery such as when, for example, the body 110 is of unitary construction, or a rechargeable battery when, for example, the body is comprised of first and second halves 120, 130 and the battery is easily accessible for recharging.

The novelty golf ball 100 may also be powered by a rechargeable USB port that extends through each of the exterior surface 112 and the core 135 to access the battery 180 stored therein. As mentioned above, the novelty golf ball 100 may also have a microphone 188 that allows a user to record a custom message, tone, sound, phrase, etc., and play the through the speaker 170 when motion of the novelty golf ball 100 is detected by the motion sensor 182. More specifically, and as best shown in FIG. 1B, the microphone 188 may extend through the rubber core 135 which has a continuous opening 137 therein. In the embodiment of the novelty golf ball 100 that has a one-piece and inseparable body portion 110, the microphone 188 may extend through the inner cavity and core 135 towards one of the speaker openings 1120 to allow a user to speak into the microphone 188 to record a phrase/sound by speaking into one of the plurality of speaker openings 1120. The recording of the sound may further be triggered by a voice command that the user speaks into the novelty golf ball 100 such as, but not limited to, saying the phrase "record" into the microphone 188.

Figure 6:
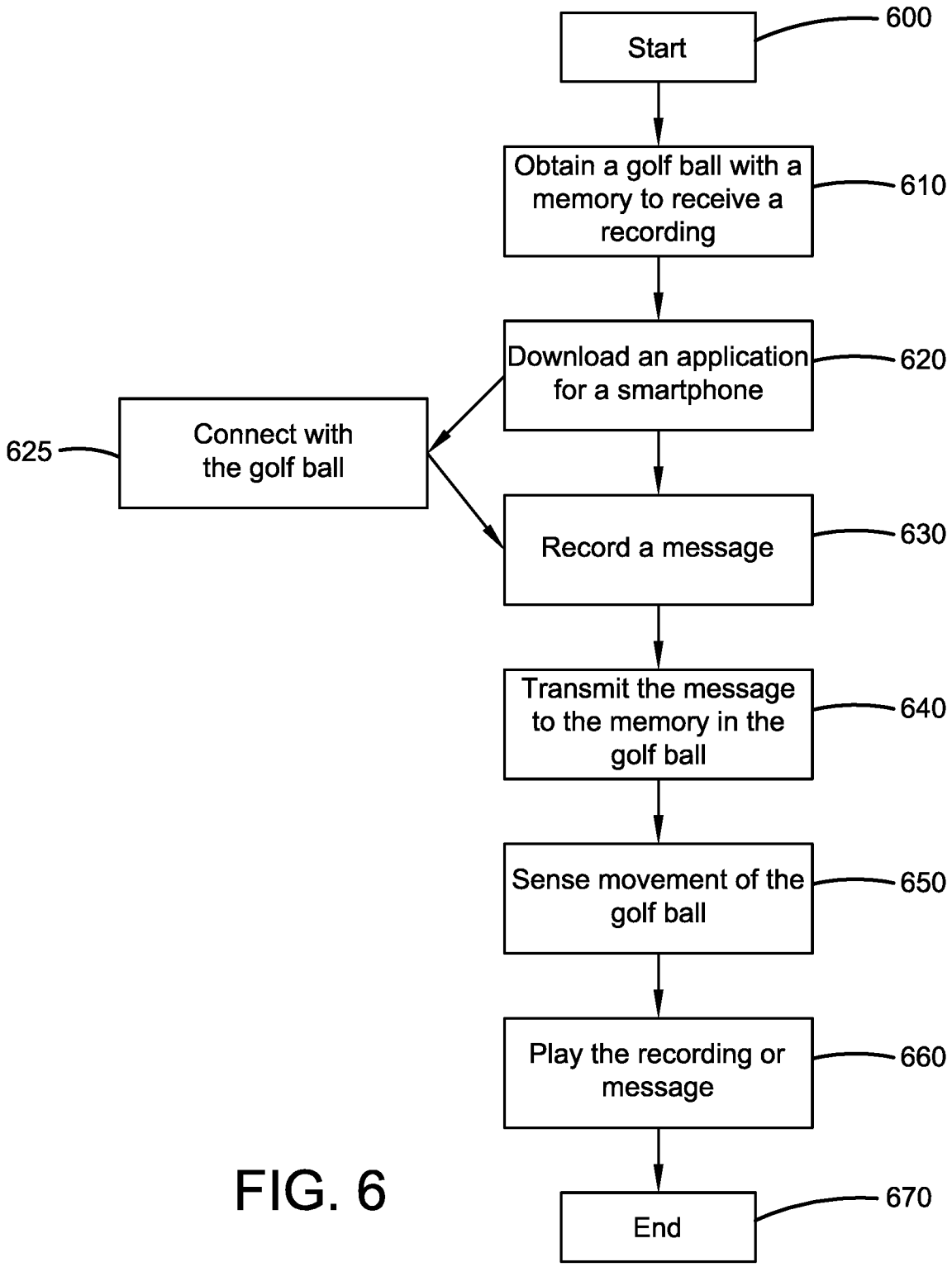
FIG. 6 illustrates a block diagram showing one potential method of using and operating the novelty golf ball of the present invention in accordance with the disclosed architecture.

FIG. 6 illustrates a block diagram showing one potential method of using and operating the novelty golf ball 100 of the present invention in accordance with the disclosed architecture. More specifically, the method begins at step 600, and at step 610 a novelty golf ball is obtained that comprises the circuit board 150, processor 1504, speaker 170, microphone 188, battery 180, wireless communication module 186, motion sensor 182 and memory 184 for receiving a sound recording. At step 620, a mobile application 190 is downloaded onto an electronic device 192. At step 625, the mobile application 190 is used to connect with the golf ball 100, and at step 630 a message is recorded. At step 640, the recorded message is transmitted to the golf ball 100. When movement is sensed by the golf ball sensor 182 at step 650, the playback of the recorded message is commenced at step 660 and the method ends at step 670.

Figure 7:
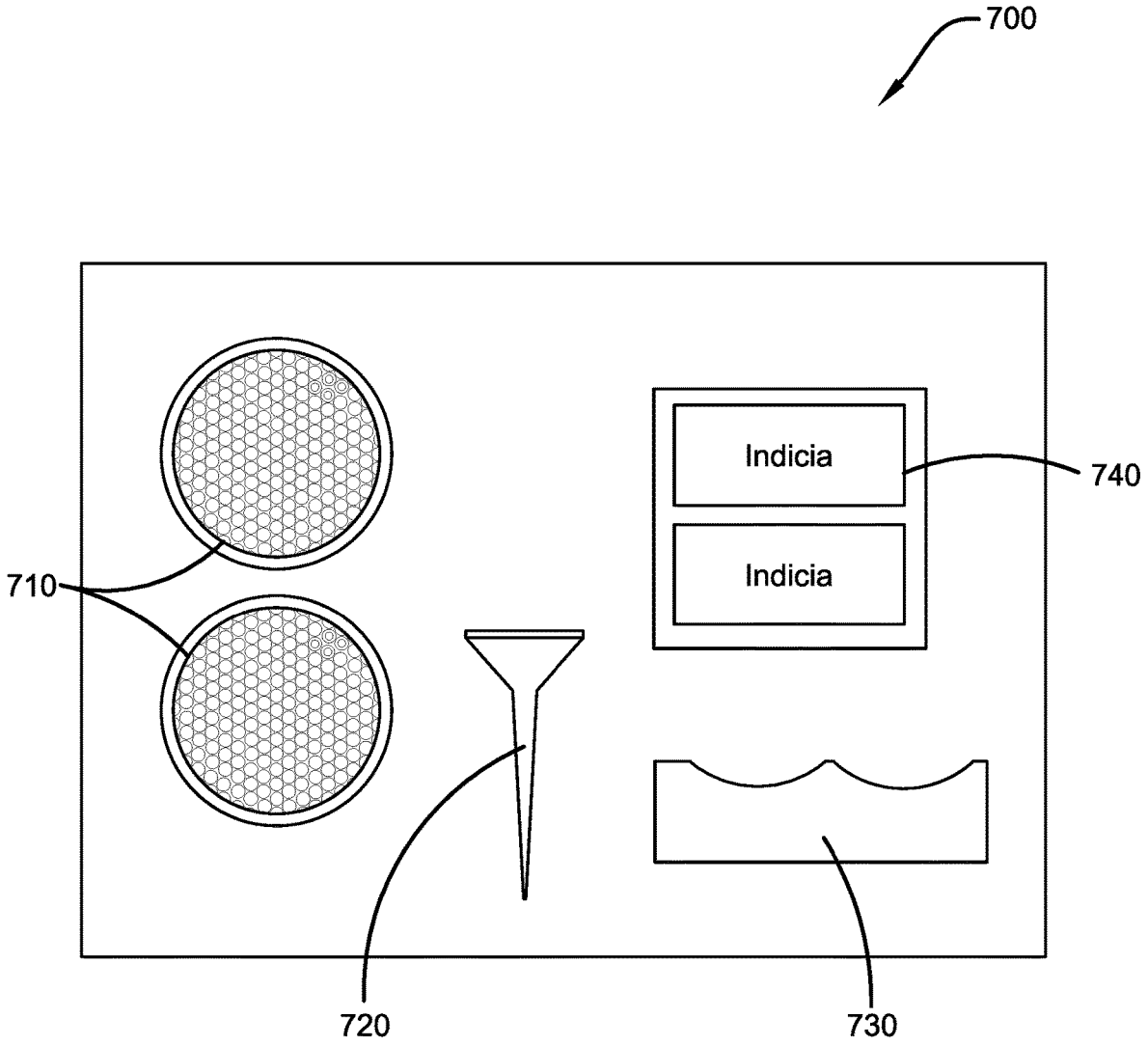
FIG. 7 illustrates a perspective view of one potential embodiment of a novelty golf ball kit of the present invention in accordance with the disclosed architecture.

FIG. 7 illustrates a perspective view of one potential embodiment of a novelty golf ball kit 700 of the present invention in accordance with the disclosed architecture. More specifically, the kit 700 includes one or more golf balls 710, display stands 720 and 730, one being a "T" stand and the other used for displaying multiple novelty golf balls on a shelf so that the purchaser can have several golf balls ready to use without the need to reprogram the golf ball used in the prior outing. In one embodiment, one or more of stands 720, 730 may resemble a traditional golf tee and allow the novelty golf ball to be stored/displayed while not in use. The stand base may also be comprised of an artificial grass base. The base may be comprised of a continuous opening that receives the tee stand, and may further have a wireless charging means to charge the golf ball 100, 710 in a differing embodiment of the device 100. Finally, the package 700 also includes a sheet of labels or decals 740 that the purchaser can use to customize the golf ball for each recipient or user of the golf ball.

Notwithstanding the forgoing, the improved golf ball 100 can by any suitable size, shape, and configuration as is known in the art without affecting the overall concept of the invention, provided that it accomplishes the above stated objectives. One of ordinary skill in the art will appreciate that the shape and size of the golf ball 100 and its various components, as show in the FIGS. Are for illustrative purposes only, and that many other shapes and sizes of the golf ball 100 are well within the scope of the present disclosure. Although dimensions of the golf ball 100 and its components (i.e., length, width, and height) are important design parameters for good performance, the golf ball 100 and its various components may be any shape or size that ensures optimal performance during use and/or that suits user need and/or preference.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A golf ball comprising:

a body comprised of an internal cavity, a first half comprising a male threaded member resting on a lip, a second half comprising a plurality of female threads recessed into a surface of the internal cavity configured to mate with the male threaded member of the first half so that the first and second halves meet in a level fashion forming a sphere, and a plurality of dimples positioned along an exterior surface of the body;

at least one continuous opening in the exterior surface;

a circuit board disposed within the internal cavity; and a plurality of electrical components housed within the internal cavity, the plurality of electrical components comprising a microphone, a speaker, a battery, a wireless communication module; and a motion sensor, and wherein a diameter of the male threaded member threads is smaller than a diameter of the first half; and wherein the golf ball is rechargeable; and wherein the circuit board is in a capacitive coupling communication with the microphone, the speaker, the battery, and the wireless communication module; and wherein the wireless communication module is in communication with a remote electronic device via a mobile application configured to allow a user to upload and edit a plurality of audio files to the circuit board and to temporarily disable the motion sensor.

2. The golf ball as recited in claim 1, wherein the continuous opening is one of a microphone or a speaker port.

3. The golf ball as recited in claim 2, wherein the continuous opening includes a grill.

4. The golf ball as recited in claim 1, wherein the circuit board comprises a memory and a processor.

5. The golf ball as recited in claim 4, wherein the circuit board further comprises the motion sensor.

6. The golf ball as recited in claim 5, wherein the motion sensor triggers a playback of a prerecorded message, a song or a phrase.

7. The golf ball as recited in claim 6, wherein the processor of the circuit board may play the prerecorded message, the song or the phrase in a select one of a particular order, a random order or by a recording type.

8. The golf ball as recited in claim 4, wherein a plurality of prerecorded sounds are stored in the memory.

9. The golf ball as recited in claim 8, wherein the processor determines an order of playback of the prerecorded sounds.

10. A golf ball system comprising:

a rechargeable golf ball comprised of an internal cavity and a plurality of dimples positioned along an exterior surface of the body;

a plurality of continuous openings extending between the exterior surface of the golf ball and the internal cavity, each of the continuous openings comprising a grill covering the respective opening configured to permit sound to escape and prevent ingress of dirt or debris;

a plurality of electrical components comprising a circuit board comprising a processor and a memory, a speaker, a battery, a wireless communication module, and a motion sensor positioned within the internal cavity;

a microphone extending into one of the plurality of continuous openings, the microphone configured to allow a user to record audio directly to the circuit board via a voice command; and a mobile application hosted on a remote electronic device in wireless communication with at least one of the plurality of electrical components via the wireless communication module configured to allow a user to upload and edit a plurality of audio files to the circuit board and to temporarily disable the motion sensor; and wherein the circuit board is coupled to the speaker and motion sensor magnetically; and wherein the circuit board is encased in and horizontally bisects the internal cavity to prevent movement of the circuit board within the rechargeable golf ball; and wherein the rechargeable golf ball is wirelessly rechargeable.

11. The golf ball system as recited in claim 10, wherein a plurality of prerecorded sounds are stored in the memory.

12. The golf ball system as recited in claim 10, wherein the motion sensor triggers a playback of a prerecorded message, a song or a phrase.

13. The golf ball as recited in claim 10, wherein the golf ball is comprised of a first half and a second half.

* * * * *